US005433012A

United States Patent [19]

Liu

[11] Patent Number: 5,433,012

[45] Date of Patent: Jul. 18, 1995

[54] ROLLING RULE

[76] Inventor: Bao-Shen Liu, 3rd Fl., No. 20, Alley 6, Lane 190, Te Hsing E. Rd., Shih Lin District, Taipei, Taiwan

[21] Appl. No.: 109,066

[22] Filed: Aug. 19, 1993

Related U.S. Application Data

[63] Continuation-in-part of Ser. No. 791,398, Nov. 14, 1991, abandoned.

[51] Int. Cl.[6] ..... B43L 13/02

[52] U.S. Cl. ..... 33/449; 33/448

[58] Field of Search ..... 33/448, 449, 450, 444, 33/454, 447

[56] References Cited

U.S. PATENT DOCUMENTS

| | | | |
|---|---|---|---|
| 158,452 | 1/1875 | Andrews | 33/448 |
| 328,668 | 10/1885 | Gooding . | |
| 374,462 | 12/1887 | Eisen . | |
| 471,459 | 3/1892 | Ariza . | |
| 630,923 | 8/1899 | Palmer | 33/448 |
| 684,005 | 10/1901 | Stokes . | |
| 781,215 | 1/1905 | Leonard . | |
| 843,374 | 2/1907 | Sturgeon . | |
| 933,798 | 9/1909 | Van Altena . | |
| 1,281,790 | 10/1918 | Kirk . | |
| 1,338,962 | 5/1920 | Rios . | |
| 1,433,839 | 10/1922 | Muller | 33/450 |
| 1,435,893 | 11/1922 | Eiane . | |
| 3,473,228 | 10/1969 | Hortman et al. | 33/449 |
| 3,726,017 | 7/1973 | DiMathe . | |
| 4,823,475 | 4/1989 | Hoezh . | |
| 5,050,309 | 9/1991 | Wang | 33/449 |

FOREIGN PATENT DOCUMENTS

| | | | |
|---|---|---|---|
| 120308 | 9/1945 | Australia | 33/449 |
| 359757 | 4/1906 | France | 33/449 |
| 626014 | 7/1949 | Germany . | |
| 827607 | 1/1952 | Germany . | |
| 25157 | 11/1956 | Germany | 33/449 |
| 1032125 | 6/1958 | Germany . | |
| 449760 | 7/1949 | Italy | 33/449 |
| 4259997 | 10/1987 | Japan . | |
| 12186 | of 1889 | United Kingdom | 33/449 |
| 13302 | of 1910 | United Kingdom . | |
| 580347 | 9/1946 | United Kingdom | 33/449 |

*Primary Examiner*—Thomas B. Will

*Attorney, Agent, or Firm*—Beveridge, DeGrandi, Weilacher & Young

[57] ABSTRACT

A rolling rule that is effective and/or diversified and/or capable of being easily positioned at a desired position and/or capable of being or easily manipulated/controlled is provided. The rolling rule includes a role body, a roller rotatably mounted in the rule body for enabling the rule body to be translated easily in a parallel fashion, a braking device mounted on one side of the rule body, which is to be exerted by a force generally along a direction parallel to a surface of a work piece for permitting the braking device to easily and conveniently brake the roller when a braking occasion is desired, and an outer surface layer having a relatively high frictional coefficient and surrounding the roller for enabling the roller to be positively controlled in motion or at a stop.

22 Claims, 19 Drawing Sheets

ROLLING RULE

FIELD OF THE INVENTION

The present application is a Continuation-In-Part application of the parent application bearing a Ser. No. 07/791,398 and a filing date of Nov. 14, 1991 now abandoned.

BACKGROUND OF THE INVENTION

In the prosecution of the parent application, the Examiner has cited thereagainst the following references, i.e., U.S. Pat. No. 4,823,475 issued to Poul E. Hoegh, U.S. Pat. No. 3,726,017 issued to Leslie L. De Mathe, U.S. Pat. No. 1,435,893 issued to H. O. Eiane, U.S. Pat. No. 1,281,790 issued to John Ames Kirk, U.S. Pat. No. 933,798 issued to H. Van Altena, U.S. Pat. No. 781,215 issued to J. T. Leonard, U.S. Pat. No. 684,005 issued to D. T. Stokes, U.S. Pat. No. 471,459 issued to V. M. Ariza, U.S. Pat. No. 1,338,962 issued to E.G. Rios, U.S. Pat. No. 843,374 issued to G. B. Sturgeon, U.S. Pat. No. 328,668 issued to C. S. Gooding, UK Pat. No. 626,014 issued to Robert Cerny, UK Pat. No. 13,302 issued to George Bibby Hartford et al., Japanese Pat. No. 63-88383 issued to Nobuo Hamazaki, German Pat. No. 827,607 issued to Wilhelm Mai, and German Pat. No. 1,032,125 issued to Chi Liang Cho.

The most pertinent references to the paresent application are U.S. Pat. No. 3,726,017 issued to Leslie L. De Mathe, U.S. Pat. No. 4,823,475 Poul E. Hoegh.

U.S. Pat. No. 3,726,017 entitled DRAFTING INSTRUMENT discloses a dial drafting device. According to FIG. 1 thereof, a braking member 34 mounted on the top of the dial drafting device is depicted therein and includes a pivotal brake arm 68 which pivots about a pair of pivot points defined by depending arms 70 which are notched at their lower end for passing through holes in the housing so that they are nonremovably mounted thereto. A resilient braking pad 76 is bonded on the brake arm 68. The lower surfaces of the depending arms 70 define a pivot axis, and the brake arm 68 is attached at one end thereof to a biasing means, such as a helical spring 72, which biases the left end of the brake arm 68 upwardly. A second magnetic member 78 is mounted on the housing so that it extends just below the extreme right end of the brake arm 68 downwardly supplementing the upwardly biasing force of the spring 72 acting on the oppisite end of the brake and thereby enhancing the braking effect of the pad 76 on the wheel 50. To sum up, the braking member 34 normally brakes the wheel 50, so, when the braking member 34 is not to brake the wheel 50, the brake member 34 is to be released by depressing the left end of the brake arm 68.

The drafting device mentioned above has the following main disadvantages:

a) The dial drafting device 34 includes a spring 72 and a second magnetic member 78 as a total biasing means for biasing the left end of the brake arm 68 upwardly. Thus, it is relatively complicated for the producing procedures of the device.

b) For the better use of the drafting device, the device must be always tightly held in order not to get inadvertently translated. The braking member 34 is mounted on the top of the device and the braking member 34 is generally exerting a force perpendicular to the surface of the work piece by the biasing force of the spring 72 and the second magnet 78.

Unbraking the wheel 50 by a finger, while translating the device by other finger(s), cannot easily be achieved. Thus, the device cannot be held relatively tightly or easily operated.

c) The braking member 34 is mounted on the fight end of the drafting device and, as mentioned above, the braking member 34 is exerted by a force perpendicular to the surface of the work piece for braking the wheel 50, so this perpendicular force which is not exerted on the longitudinal middle of the device can result in a non-equilibrium of the device. Thus, the working precision of the device is affected.

d) There is a plate 18 receiving some discs on the left end of the device, so it is clear that the draftman cannot easily hold the device. Whereas, it is well known that a drafting device is to be easily held in the draftman's hand so that the draftman can feel ease with the drafting device.

e) The structure of the drafting device is relatively complicated so that the cost of producing this device is relatively high.

U.S. Pat. No. 3,726,017 entitled DRAFTING INSTRUMENT discloses a drafting device. This instrument still suffers from the following disadvantages:

a) A brake means according to this invention is manually manipulated by a brake control knob so that the brake function is very hard to be executed when the draftmen is using this instrument.

b) The whole structure of this instrument is too complicated so that the producing cost is relatively high.

c) This instrument is still hard to be tightly held easily.

It is therefore attempted by the Applicant to deal with the above situation encountered by the prior art.

SUMMARY OF THE INVENTION

It is therefore an object of the present invention to provide a rolling rule capable of being desiredly positioned and/or being effective and diversified.

It is therefore another object of the present invention to provide a rolling rule whose structure is simple.

It is therefore a further object of the present invention to provide a rolling rule which is low cost.

It is therefore still an object of the present invention to provide a rolling rule which can be easily/tightly held and conveniently/easily manipulated.

It is therefore yet an object of the present invention to provide a rolling rule which can respectively clamp different ruling gages for different purposes.

It is therefore an additional object of the present invention to provide a rolling rule which can be equipped with a replaceable ruling gage. In accordance with the present invention a rolling rule includes a rule body, a roller rotatably mounted in the rule body for enabling the rule body to be generally parallelly translated easily, a braking means mounted on one side of the rule body, which is exerted by a force generally along a direction parallel to a surface of a work piece for permitting the braking means to easily and conveniently brake the roller when a braking occasion is desired, and an outer surface layer having a relatively high frictional coefficient and surrounding the roller for enabling the roller to be positively controlled in motion or at a stop.

Certainly, the roller can include thereon an intermediate tubular member and two end wheels providing thereon the outer surface layer.

Certainly, the rolling rule can further include a first lower piece connected to the rule body and a clamping means held attached to the rule body and adapted to replaceably clamp thereto a first ruling gage. The clamping means can include a first upper piece disposed above the lower piece and capable of cooperating with the lower piece to clamp therebetween the ruling gage, and a packing medium enabling the pieces to tightly clamp therebetween the ruling gage.

Certainly, the first ruling gage can include a stem which has a terminal having an extension which has a base line, a gage body having a corresponding terminal forming thereon a protractor which has a graduation, and a positioner mounted between the terminal and the corresponding terminal for keeping the stem at a specific inclination with respect to the rule body. The stem can further include at least one groove provided on the stem, and at least one corresponding packing means mounted on the at least one groove for clamping thereby a second ruling gage.

Certainly, the pieces can be integrally formed to the rule body and the upper piece can be approximately intermediately positioned on the rule body.

Alternatively, the rolling rule can further comprise a second upper piece and the upper pieces can be disposed near two opposite ends of the rule body and the lower piece has a length approximately equal to that of the rule body. The rolling rule can further comprise at least a second lower piece coplanar with the first lower piece. The packing medium can be one selected from a group consisting of an arc surface integrally formed on said first upper piece and a bolt bolting through said first upper piece.

Certainly, the first lower piece can have two ends thereof respectively pivotally connected to two corresponding ends of the rule body. The lower piece can include at least one said clamping means.

Certainly, the first lower piece can have one end pivotally connected to one corresponding end of the rule body. The one end can have a base line and the one corresponding end can form thereon a protractor. The one end can further include at least a groove for mounting thereon at least a clamping bolt for clamping the ruling gage. The lower piece can include one said clamping means.

Certainly, the rolling rule can further comprise a positioner mounted between the one end and the one corresponding end for positioning the lower piece at a specific inclined angle with respect to the rule body.

Certainly, the roller can include thereon an annular sleeve for engaging with the braking means. The sleeve can have a surface being one selecting from the group consisting of an annular outer toothed surface and a relatively highly frictional surface.

Certainly, the braking means can include a lever pivotally fixed to the rule body, and having a first end engageable with the roller and a second opposite end, and a resilient member mounted between the rule body and one of the first and second ends for always urging the one end away from the rule body.

Alternatively, the braking means can include a braking medium movably confined in the rule body and engageable with the roller, and a resilient member mounted between the braking medium and the rule body for always urging the braking medium away from the rule body. The braking medium can be elongate and the roller can have thereon two annular sleeves engageable with said braking medium. The roller can include thereon an annular sleeve, and the sleeve and the braking medium respectively include a ridge and a corresponding indentation capable of matching therein said ridge.

Certainly, the rolling rule can further include a distance-showing device for showing how much distance the roller has been translated forwards. The distance-showing device can include a window mounted on the rule body, the graduation mounted on the roller, and a second base line mounted on the rule body. Certainly, the rolling rule can further include an inverse distance-reading device for showing how much distance the roller has been translated backwards.

The present invention may best be understood through the following description with reference to the accompanying drawings, in which:

DETAILED DESCRIPTION OF THE PREFERRED EMBODIMENTS

Referring now to FIG. 2A to FIG. 2D, a rolling rule according to the present invention includes a rule body E having rotatably mounting therein a roller A enabling body E to be translated parallel to the underlying surface, two lower pieces EP1 and two clamping means EP mounted on body E for clamping thereto a ruling gage H. Rule body E includes a hollow portion E1, two longitudinal end walls E2 respectively having shaft holes E3 and respectively provided with grooves E4 for being springy so that walls E2 can mount therebetween roller A more easily, and a transparent top window E5 having a base line E6. Each clamping means EP has [a lower piece EP1,]an upper piece EP2 disposed above lower piece EP1, and a packing medium EP21 enabling pieces EP1 & EP2 to tightly clamp therebetween the ruling gage. Packing medium EP21 can be an arc surface integrally formed to upper piece EP2 or a bolt bolting through upper piece EP2. Pieces EP1 & EP2 can be integrally formed to rule body E. Roller A includes an intermediate tubular member A1 provided with a graduation A4 corresponding to base line E6. A distance-showing device consists of graduation A4, base line E6, and transparent top window E5 so that one can easily know the distance of parallel travel of rule body E, and two end wheels A2 each of which has a shaft A3 rotatably mounted in one corresponding shaft hole E3. End wheels A2 is surrounded therearound by an outer surface layer AR having a relatively high frictional coefficient for enabling the present rolling rule to be positively controlled in motion or at a stop.

Figure 1:
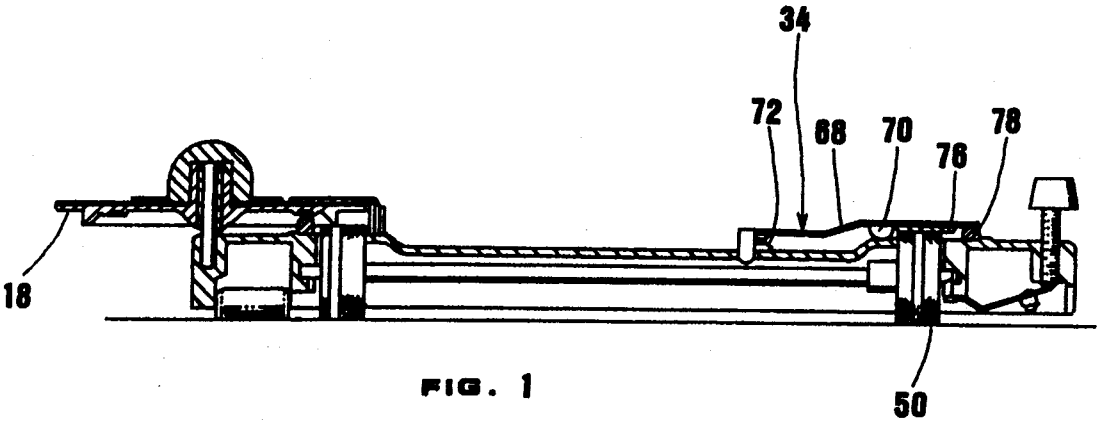
FIG. 1 shows a longitudinal, vertical, sectional view of a dial drafting device according to U.S. PAT. No. 3,726,017 entitled DRAFTING INSTRUMENT.
Figure 2A:
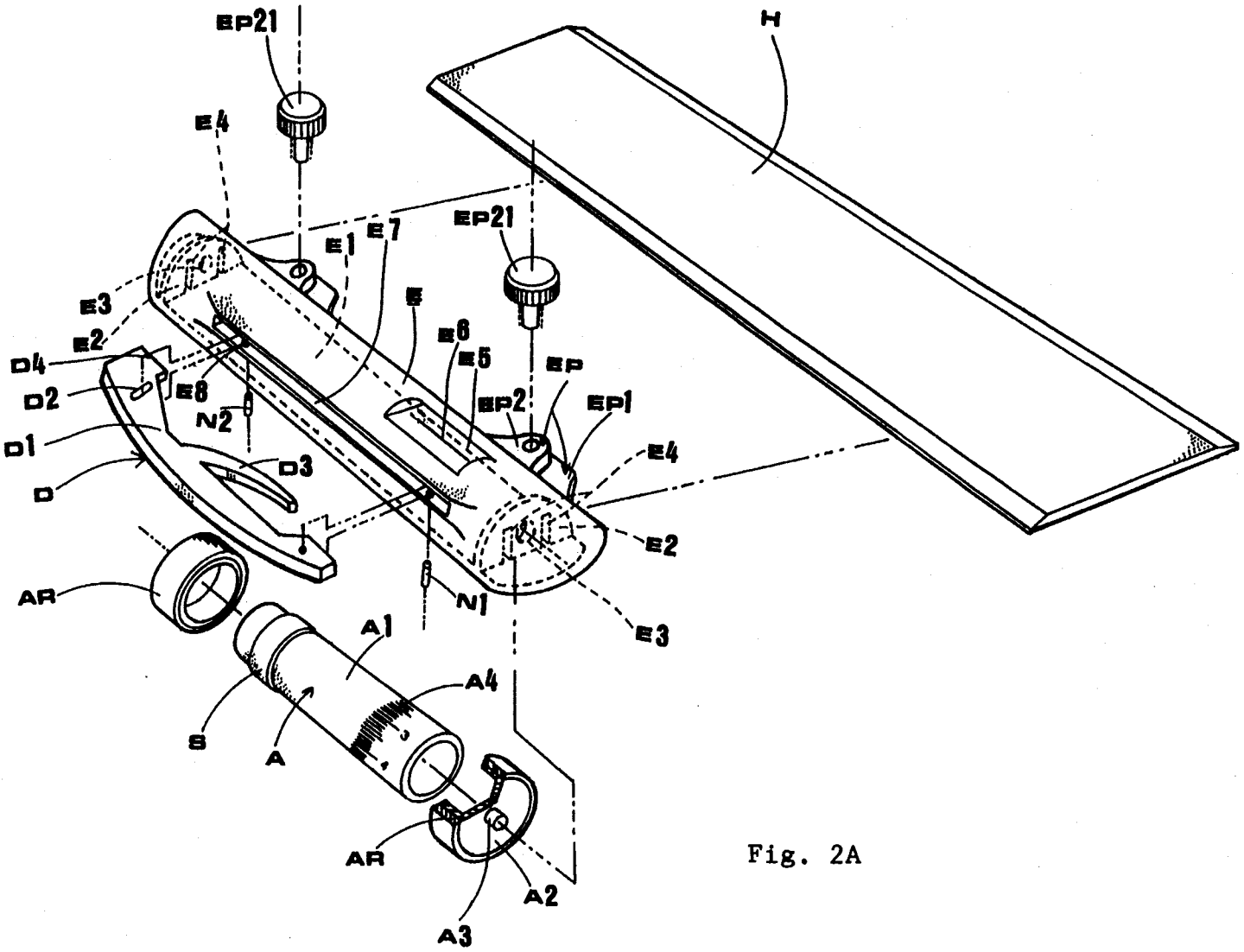
FIGS. 2A & 2B are an exploded and a fragmentary top view respectively, showing a preferred embodiment of a rolling rule of the present invention.
Figure 2B:
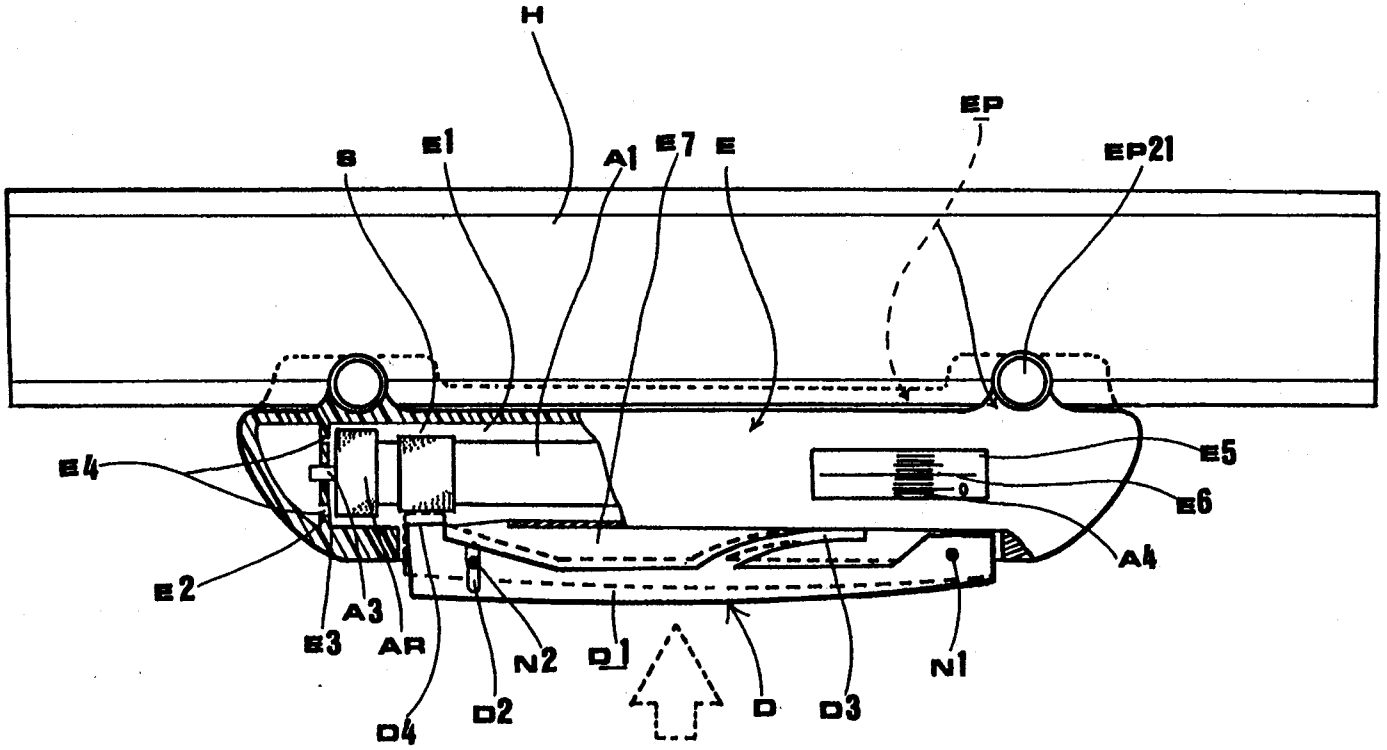
Figure 2E:
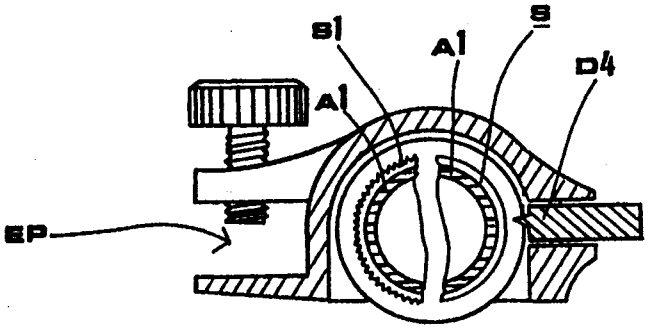
FIG. 2E is a sectional end view showing a modified roller for a rolling rule according to the present invention.
Figure 2C:
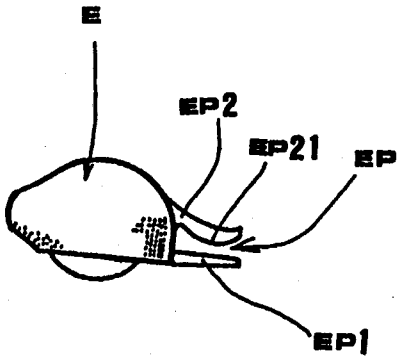
FIGS. 2C & 2D are end views showing two embodiments of clamping means respectively attached to a rolling rule according to the present invention.
Figure 2D:
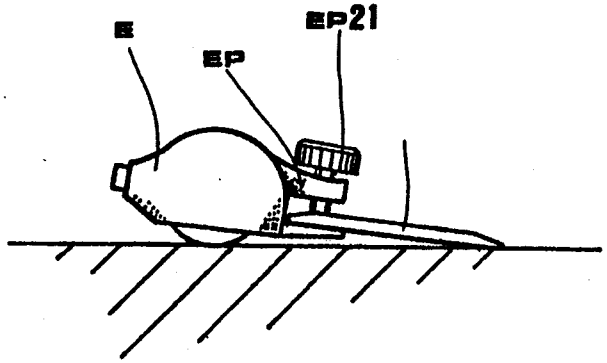
Figure 3A:
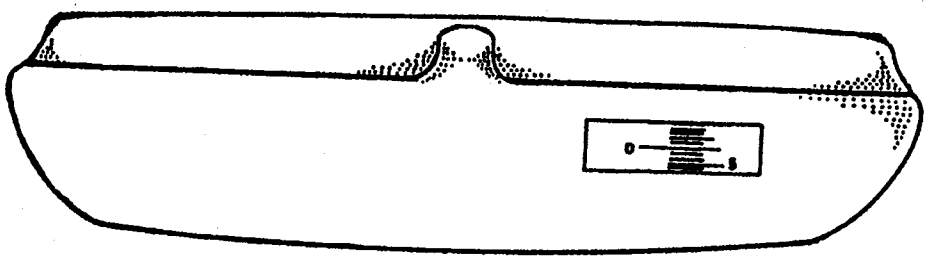
FIGS. 3A to 3E are top views respectively showing preferred embodiments of a rolling rule of the present invention.
Figure 2F:
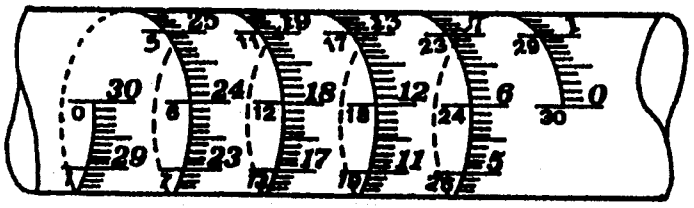
FIGS. 2F to 2H show different scales of the graduation for a rolling rule according to the present invention.
Figure 2G:
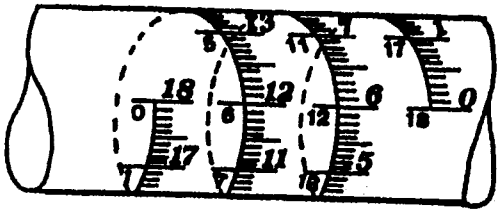
Figure 2H:
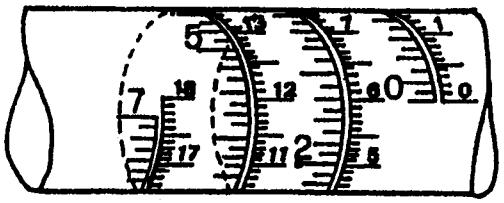
Figure 3B:
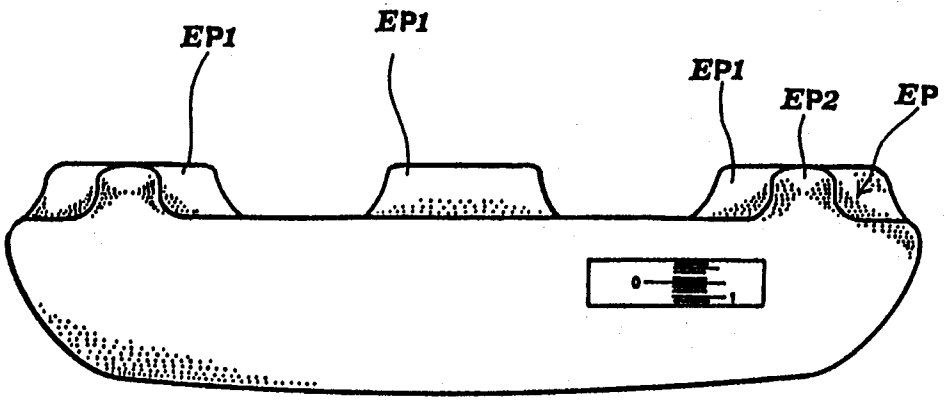
Figure 3C:
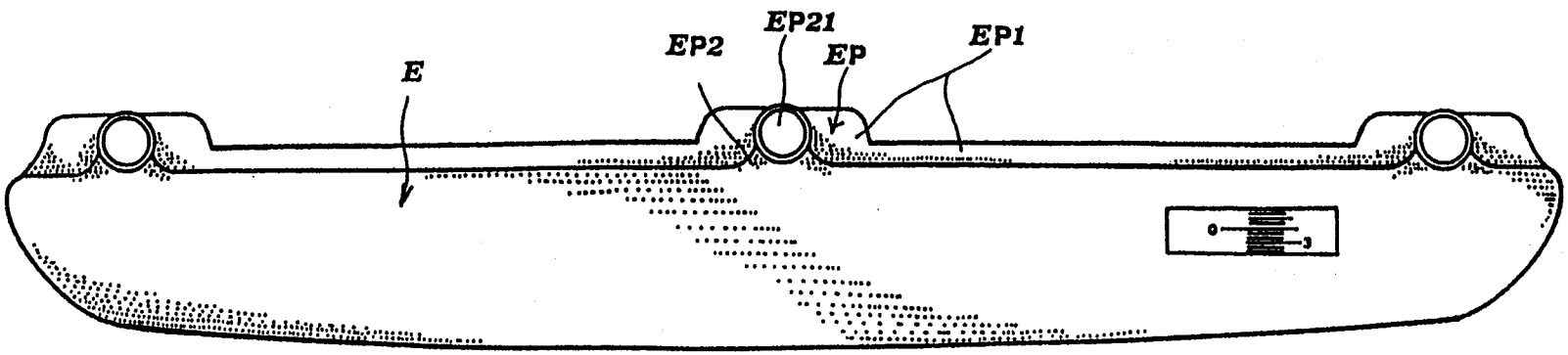
Figure 3D:
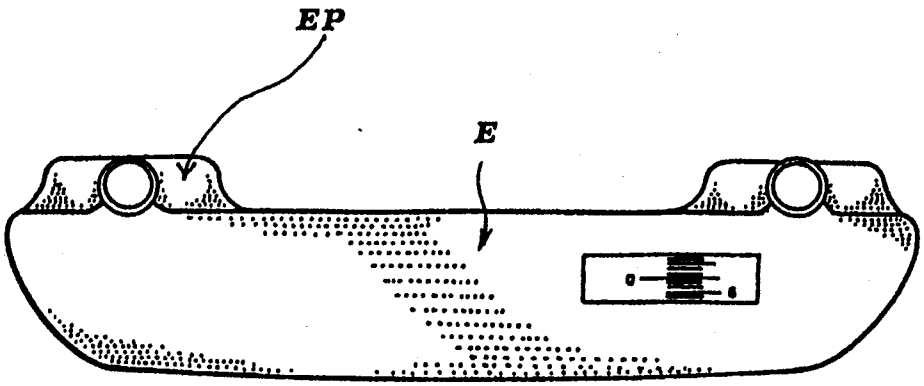
Figure 3E:
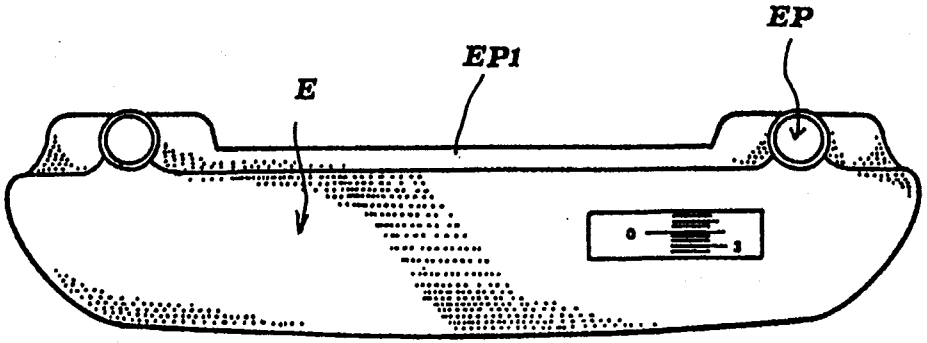
Figure 4B:
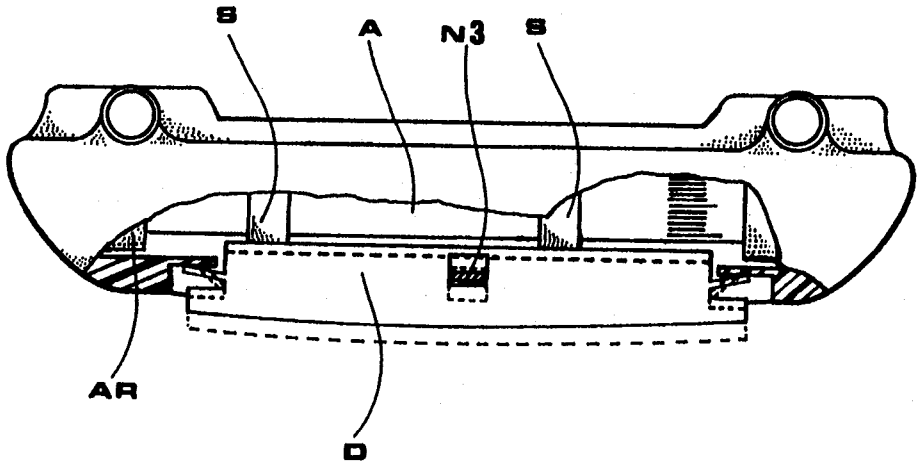
FIGS. 4A & 4B are an exploded and a fragmentary top view showing another preferred embodiment of a rolling rule according to the present invention.
Figure 4A:
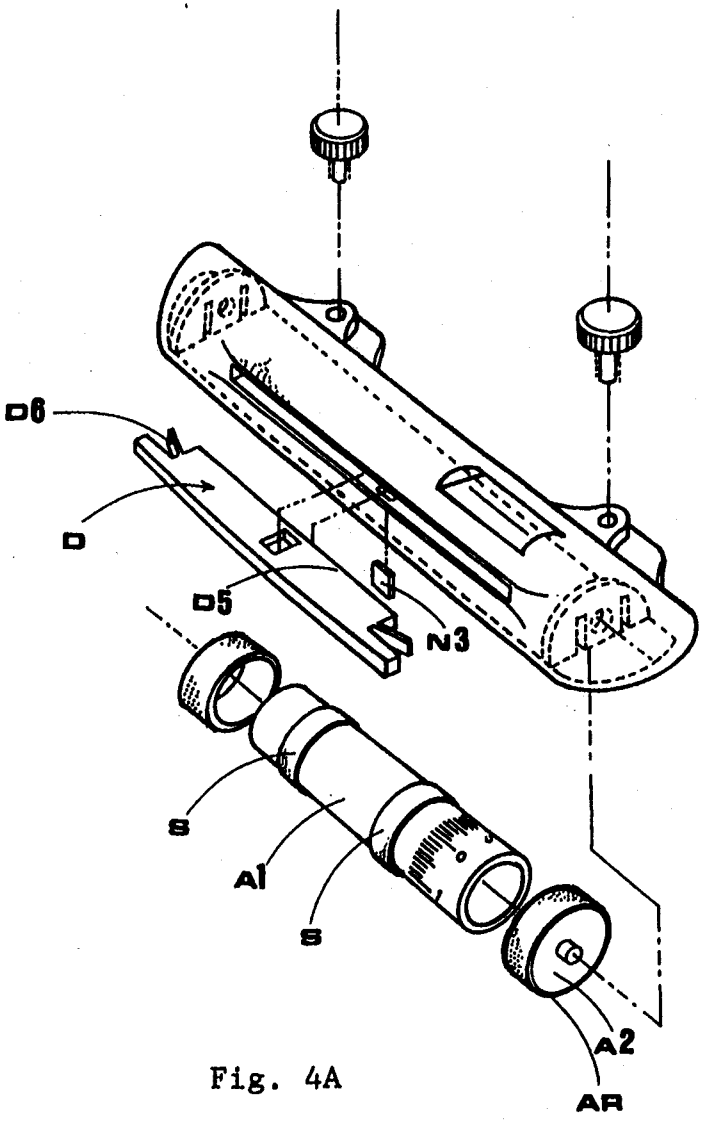
Figure 4C:
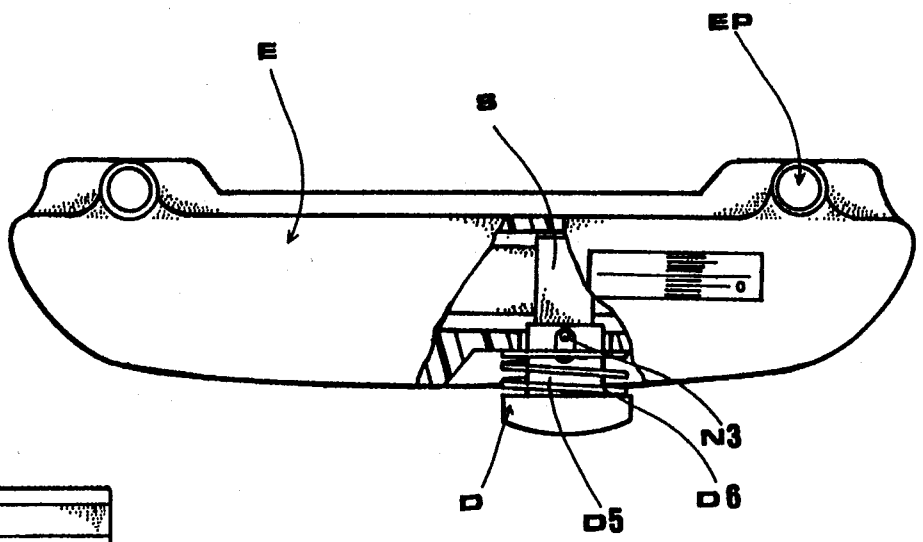
FIGS. 4C & 4D are top views respectively showing two additional rolling rules according to the present invention.
Figure 4D:
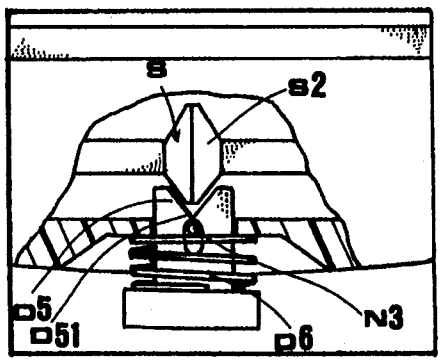

Preferably the present rolling rule further includes a braking means D mounted between body E and roller A for controlling whether roller A should be set to be rotatable with respect to body E. Braking means D can include a lever D1 which is partly received in a longitudinal groove E7 of body E and includes an end pivotally pinned to rule body E by a pin N1, a pinhole D2 passing therethrough a pin N2 penetrating into opposite pinholes of body E for confining the pivotal movement of lever D1, an opposite end D4 engageable with an annular sleeve S sleeved on roller A, and a resilient member D3 integrally formed to lever D1 for always urging end D4 away from rule body E or sleeve S. As shown in FIG. 2E, the sleeve S can have an annular outer toothed surface S1 or an annular frictional surface so that sleeve S and end D4 can have a positive engagement therebetween. FIGS. 2F to 2H shows different lengths and scales of graduation A4, and it is to be noticed that any graduation A4 according to FIGS. 2F to 2H can function regardless of whether the present rolling rule is translated backwards or forwards.

As shown in FIGS. 3A to 3E, the number of the upper piece EP2 can be one or larger than two, and so is that of the lower piece EP1. Alternatively, the lower piece EP1 can be an integral one, and can have a lengh approximately equal to that of rule body E, and thus can more stably support thereon a ruling gage.

As shown in FIGS. 4A to 4D, the braking means D can alternatively include a braking medium D5 movably confined in body E by means of a pinning medium N3 and engageable with annular sleeve S of roller A, and a resilient member D6 mounted between braking medium D5 and body E. If the braking medium D5 is elongate, roller A preferably has thereon two annular sleeves S. Certainly, the resilient member D6 can be integrally formed to braking medium D5. If sleeve S and braking medium D5 are respectively provided with a ridge S2 and a corresponding indentation D51, they will have a more effective and positive engagement therebetween.

Certainly, the lever D1 can alternatively be designed in a manner that the resilient member D3 always urges end D4 against sleeve S. End wheels A2 can be surrounded therearound by an outer surface layer AR having a relatively high frictional coefficient for enabling the present rolling rule to be positively controlled in motion or at a stop.

Figure 5:
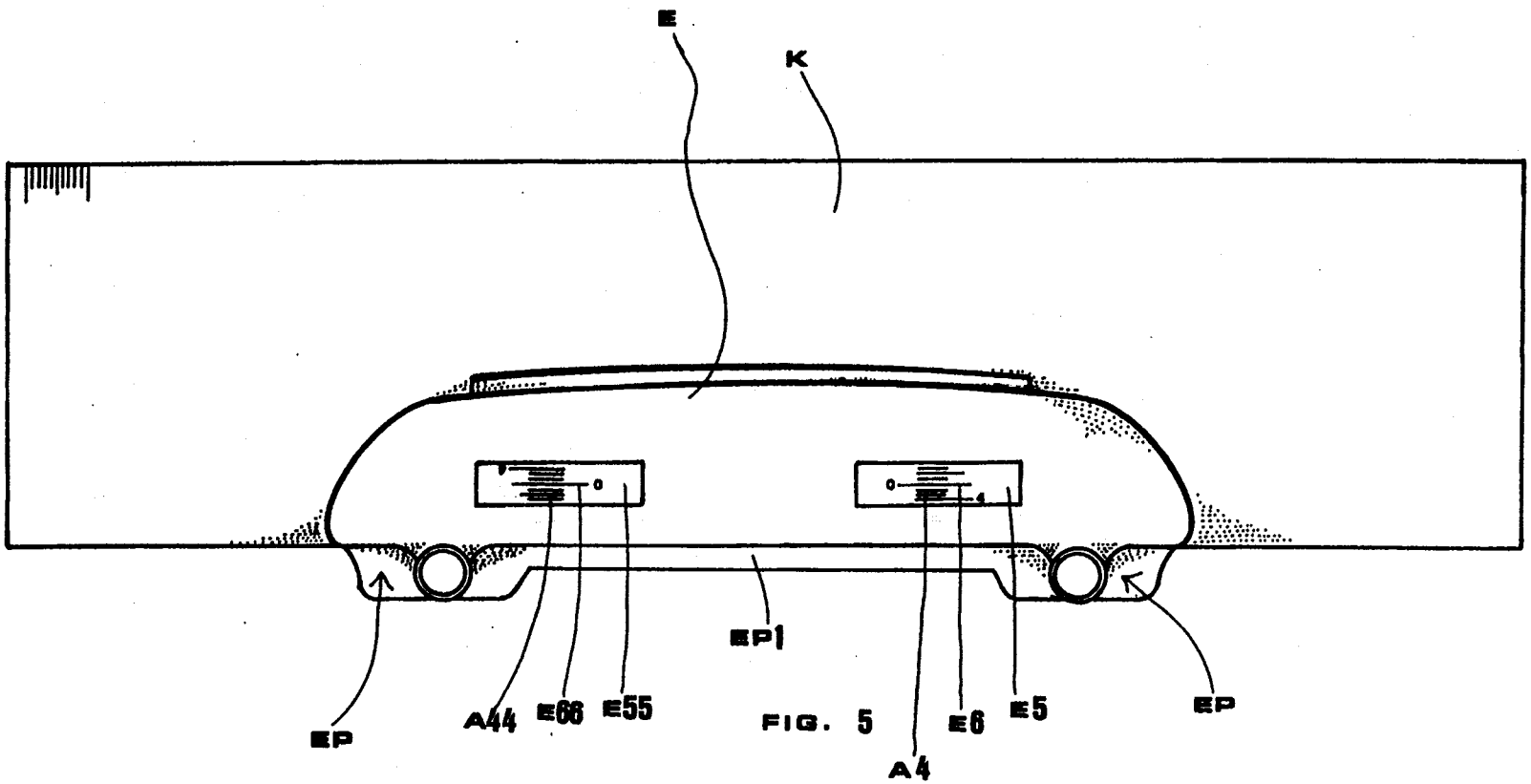
FIG. 5 is a top view showing an additional embodiment of a rolling rule according to the present invention.

FIG. 5 shows that the rule body E integrally forms thereto a ruling gage K with clamping means EP thereof still being capable of attaching thereto a ruling gage. It is to be specially noted that besides distance-showing device, there is an inverse distance-showing device consisting of a transparent top window E55 having a base line E66 mounted on the opposite position of rule body E and an inverse graduation A44 mounted on the opposite position of roller A for conveniently applying the present rolling rule either backwards or forwards.

Figures 6A, 6B:
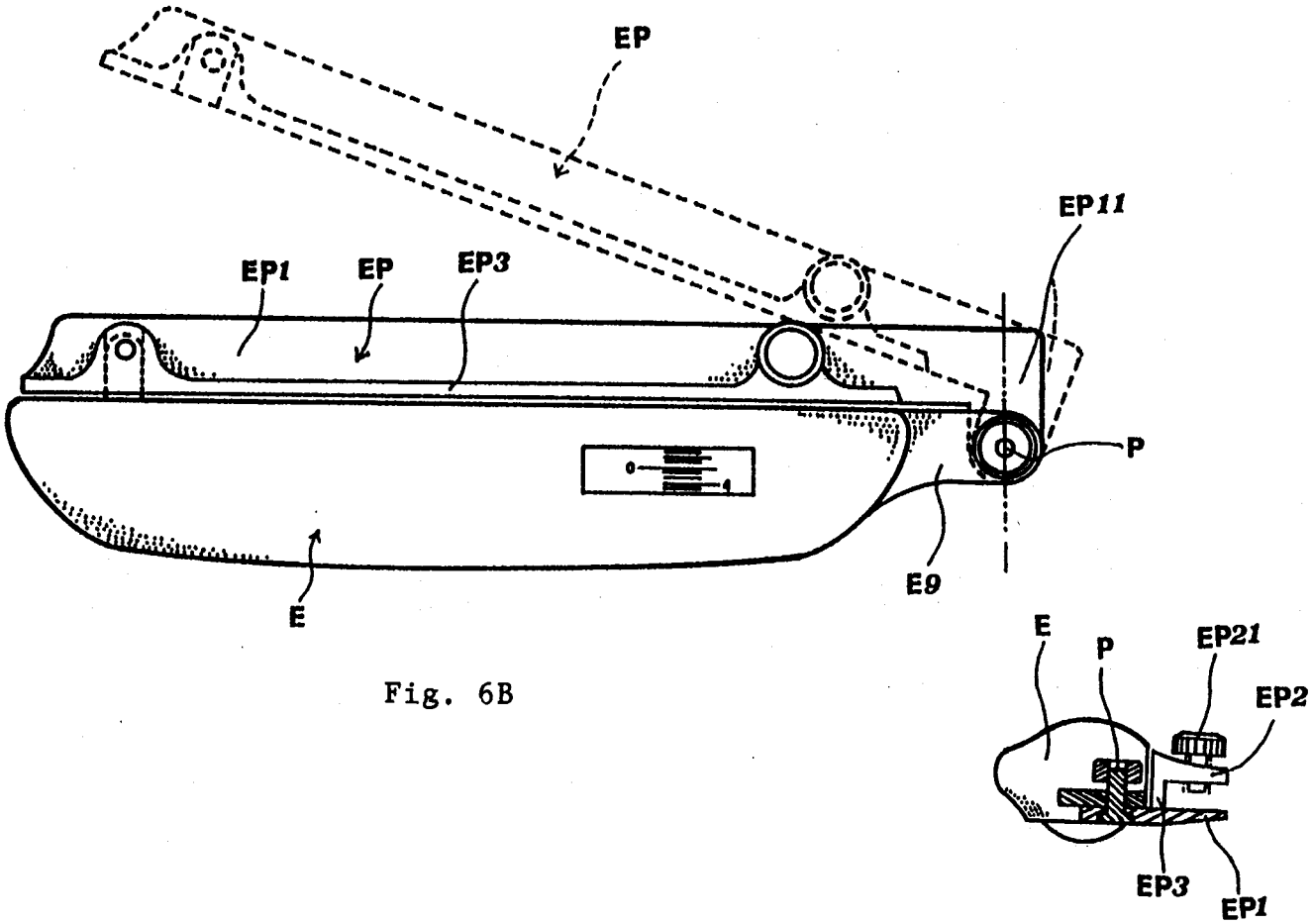
FIGS. 6A & 6B are a top and an end views showing further a preferred embodiment of a rolling rule according to the present invention.
Figure 6C:
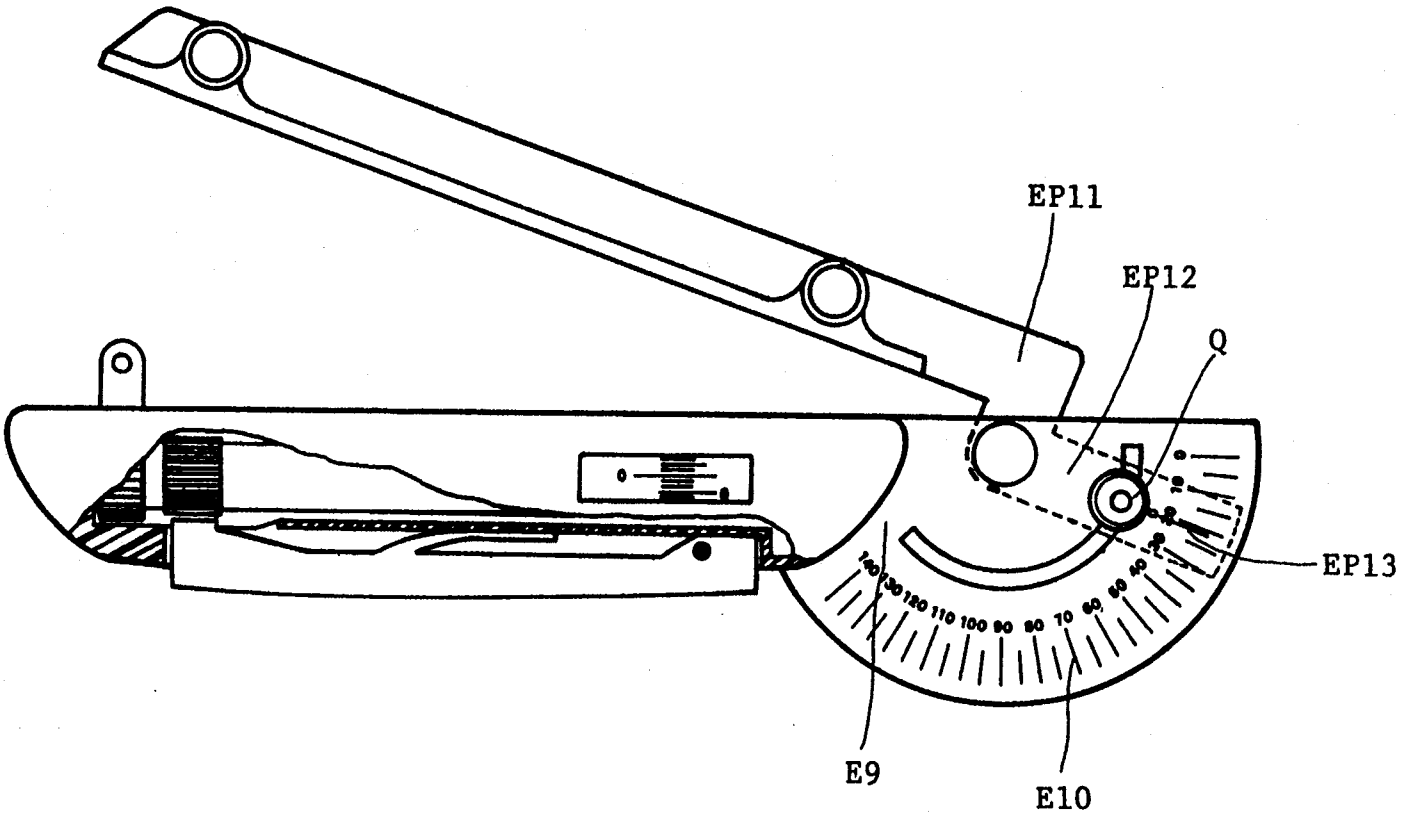
FIG. 6C is a fragmentary top view showing a modified embodiment of a rolling rule in FIG. 6B.

As shown in FIGS. 6A & 6B, the clamping means EP having upper piece EP2 and an intermediate EP3 connecting together the upper piece EP2 and a lower piece EP1 can be independent from rule body E and one end EP11 of the lower piece EP1 thereof can be pivotally connected to one corresponding end E9 by means of a pivot P. End EP11 can have an extension EP12 having a base line EP13, as shown in FIG. 6C, and corresponding end E9 can form thereon a protractor having a graduation E10 so that the user can know at what angle the lower piece EP1 is kept inclined with respect to rule body E.

Figure 6D:
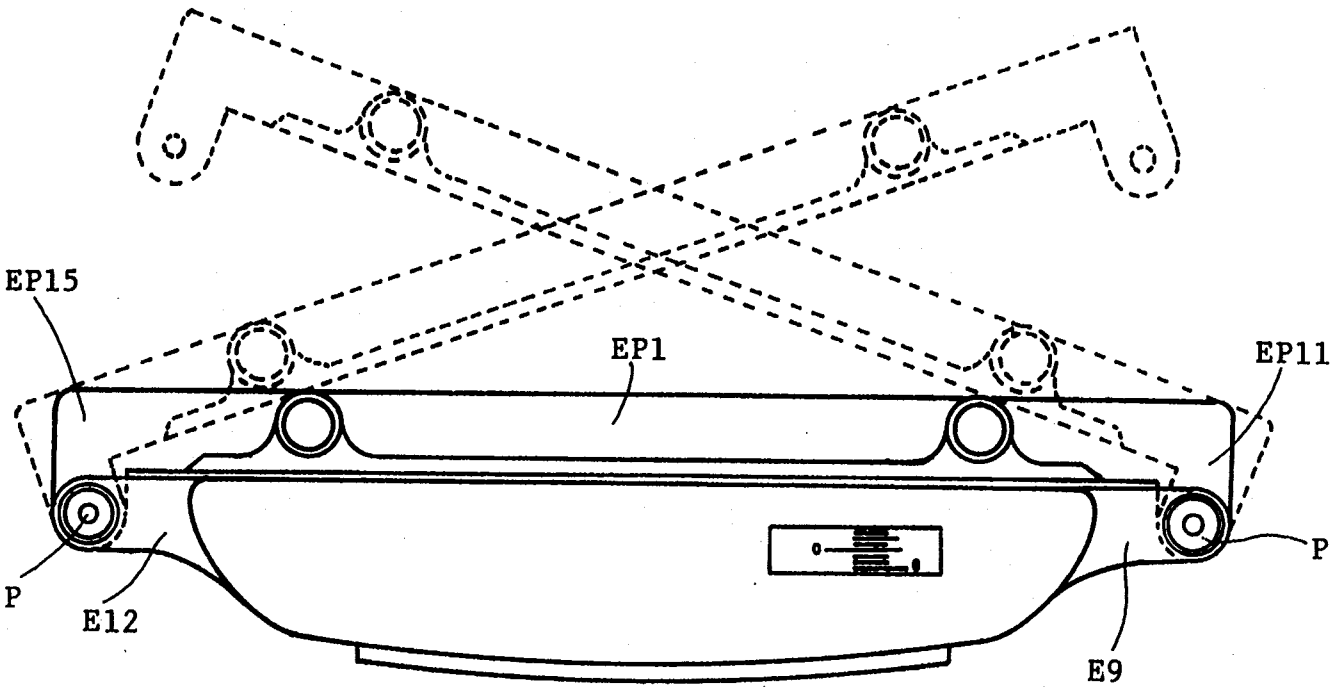
FIGS. 6D & 6E are two further top views showing another two modified embodiments of the rolling rule in FIG. 6B.
Figure 6E:
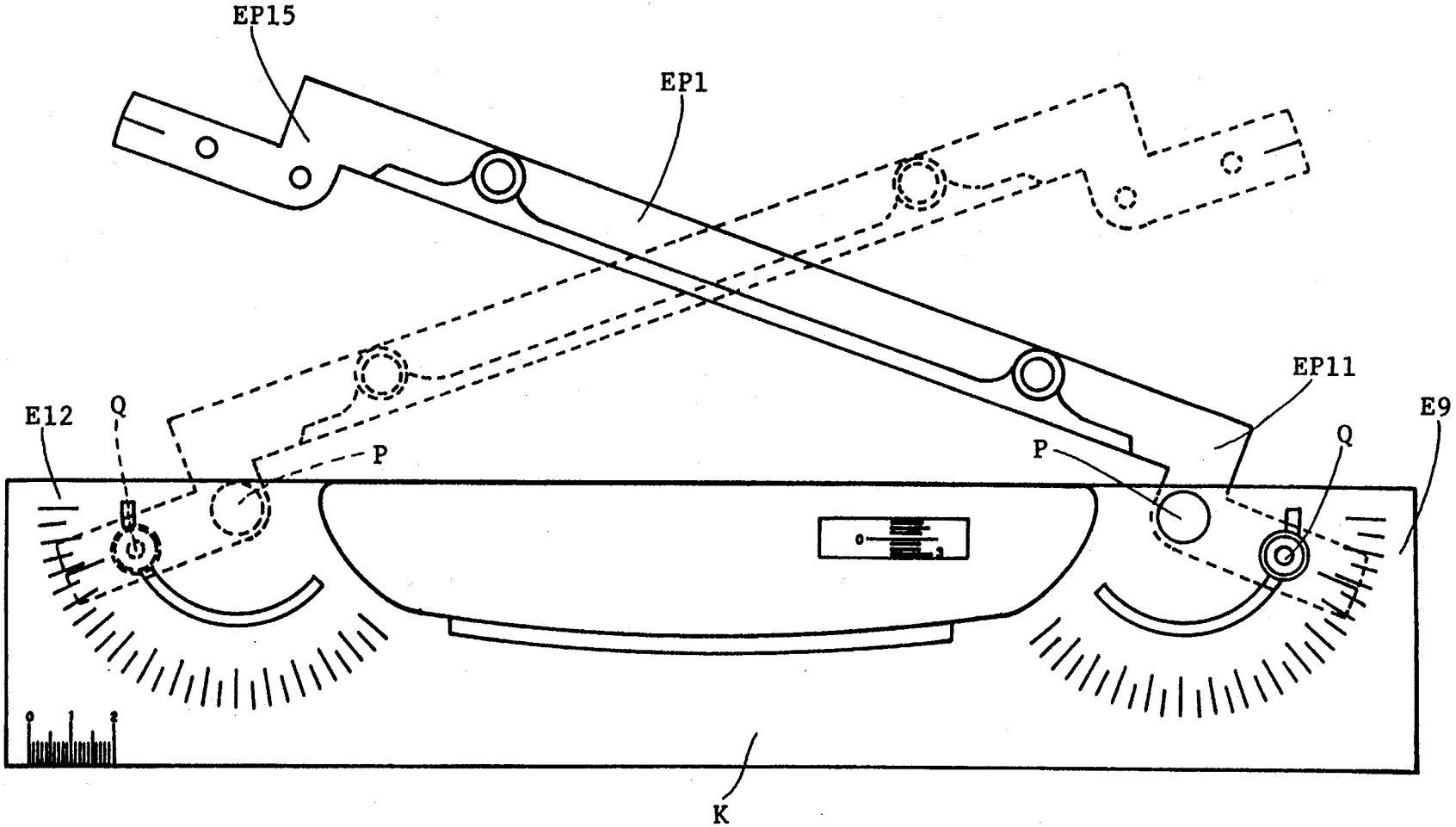
Figure 6F:
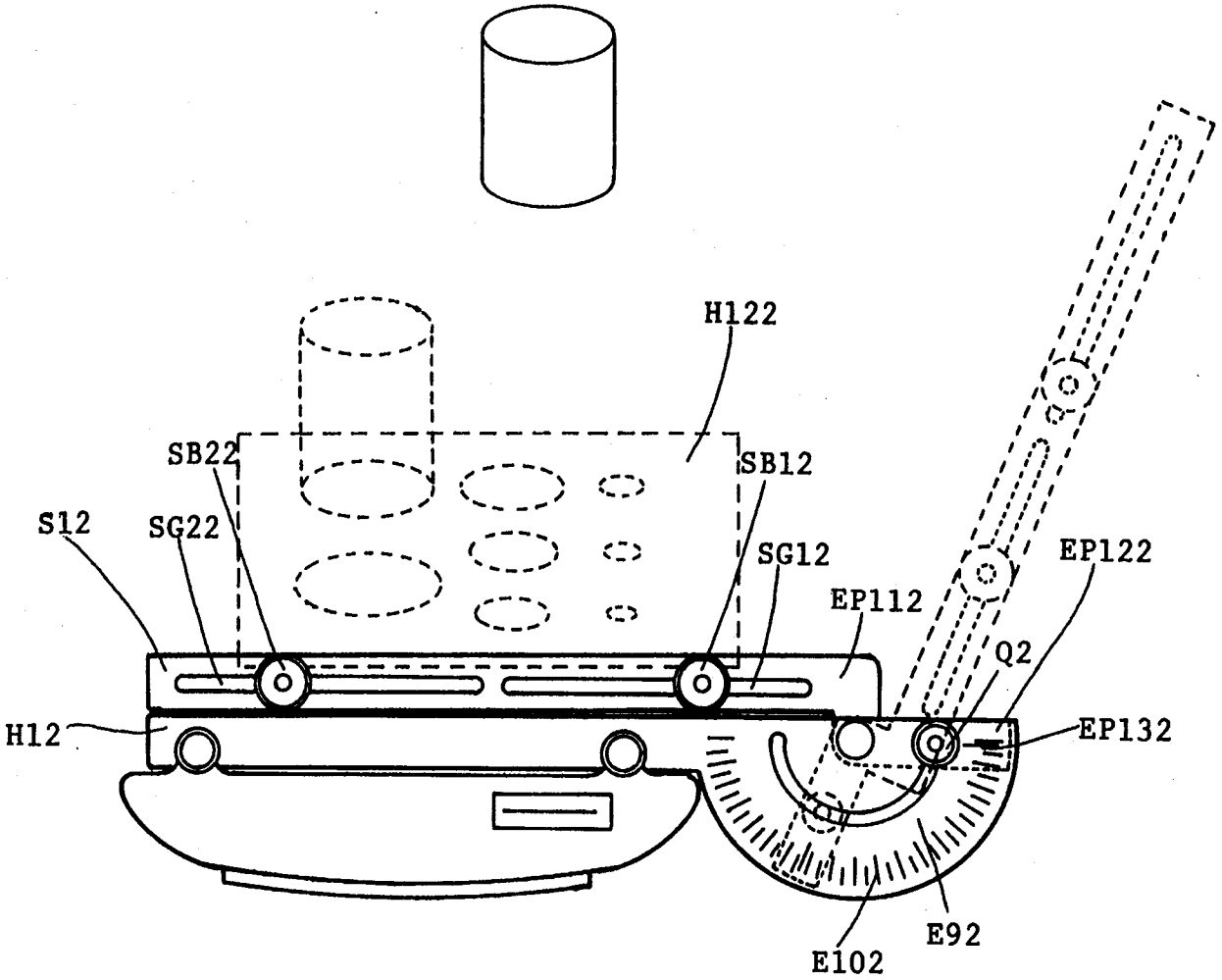
FIGS. 6F & 6G show the applications of a further modified embodiment according to the present invention.
Figure 6G:
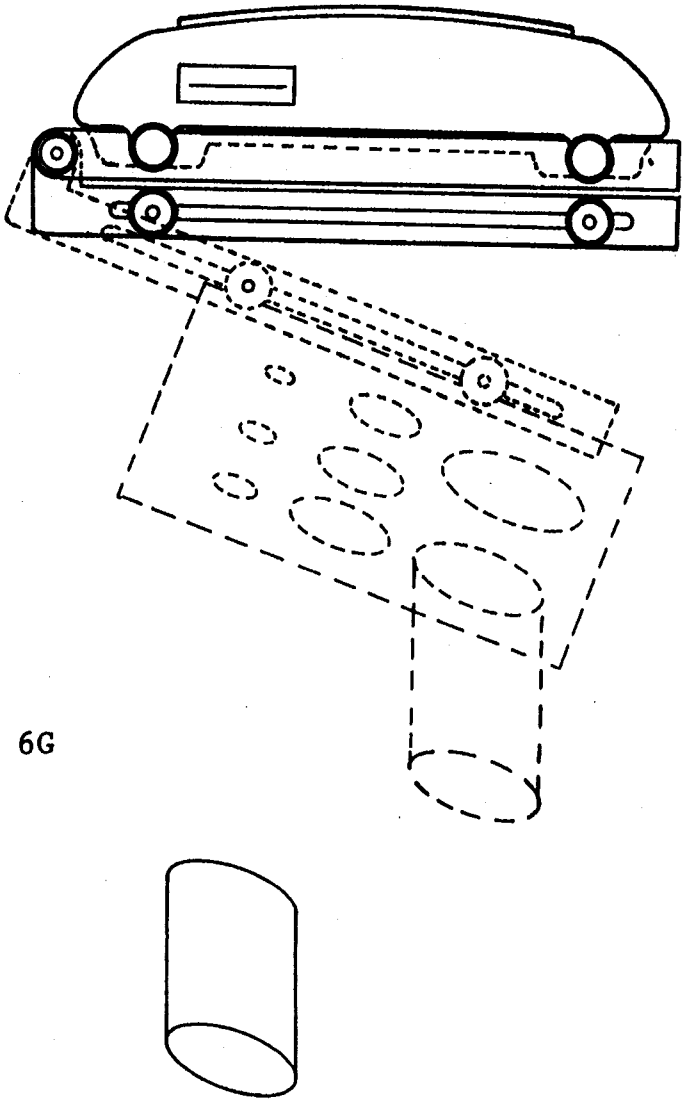

Preferably ends EP11 and E9 mount therebetween a positioner Q for keeping lower piece EP1 at a specific inclination with respect to rule body E. Certainly, positioner Q can be a nut and a bolt or the like. Alternatively, as shown in FIGS. 6D & 6E, another end EP15 of lower piece EP1 can also be pivotally connected to another corresponding end E12 of rule body E by means of another pivot P so that the user can desiredly have end EP11 or EP15 really pivotally connected to end E9 or E12. FIG. 6E shows that a back ruling gage K, as shown in FIG. 5, can serve as ends E9 & E12. FIGS. 6F & 6G show the applications of a further embodiment according to the present invention. A ruling gage according to FIG. 6F includes a stem S12, a gage body H12, and a positioner Q2. A terminal EP112 of stem S12 can have an extension EP122 having a base line EP132, and a corresponding terminal E92 of gage body H12 can form thereon a protractor having a graduation E102 so that the user can know at what angle stem S12 is kept inclined with respect to rule body E. Preferably terminal EP112 and corresponding terminal E92 mount therebetween positioner Q2 for keeping end EP112 at a specific inclination with respect to rule body E. Certainly, positioner Q2 can be a nut and a bolt or the like. It is to be noticed that there are two grooves SG12 and SG22 mounted on stem S12 for two packing means SB12 and SB22 to be mounted on the two grooves SG12 and SG22 for clamping another ruling gage H122. Therefore the distance of the two packing means can be adjusted for clamping ruling gage of different sizes. Besides, by adjusting the angle between end EP112 and body E, the draftman can draft different figures of different perspectives.

Figure 7:
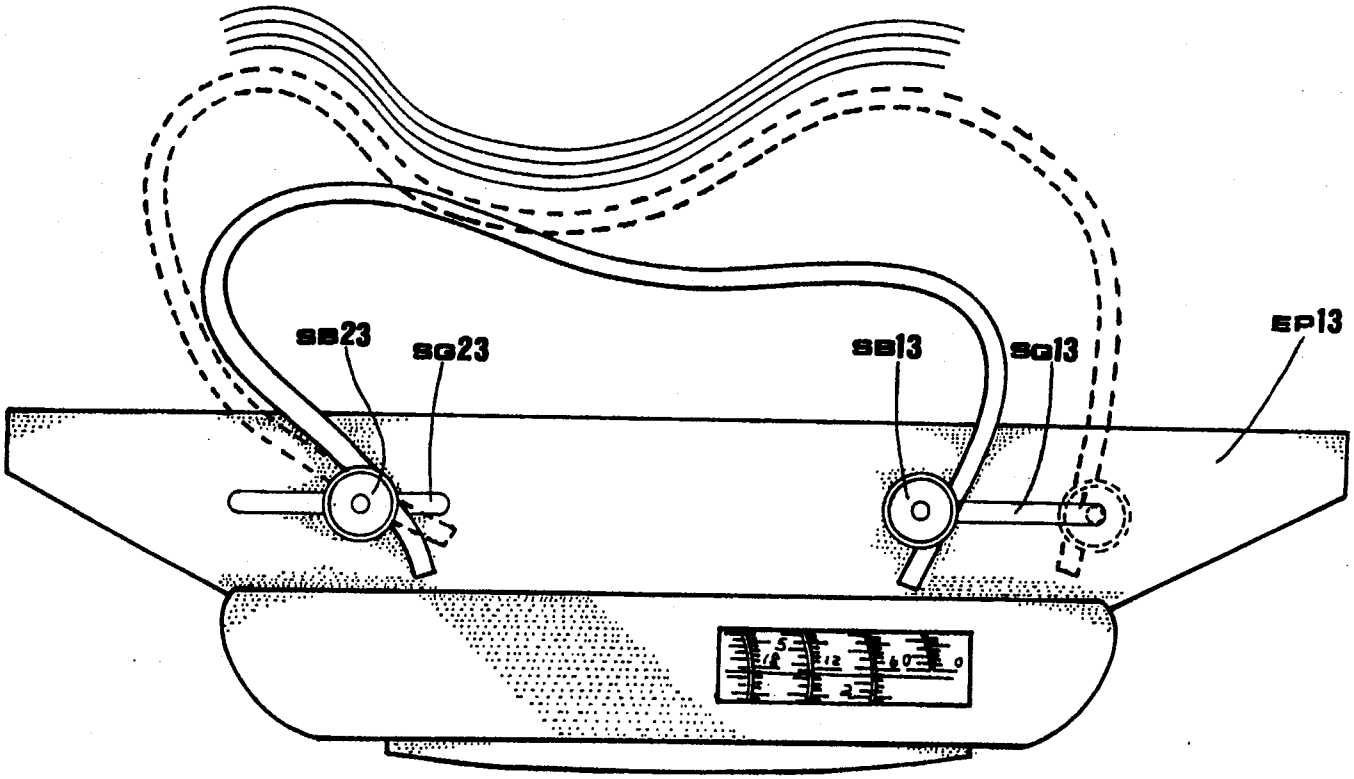
FIG. 7 is a top view showing another preferred embodiment of a rolling rule according to the present invention.

FIG. 7 shows another application according to the present invention having the lower piece EP13 integrally formed to a ruling gage which is mounted by two grooves SG13 and SG23 mounted for two another packing medium SB13 and SB23 to be mounted on the two grooves SG13 and SG23. Therefore, any kinds and shapes of rules can be clamped by two packing medium SB13 and SB23 for different purposes.

Figure 8A:
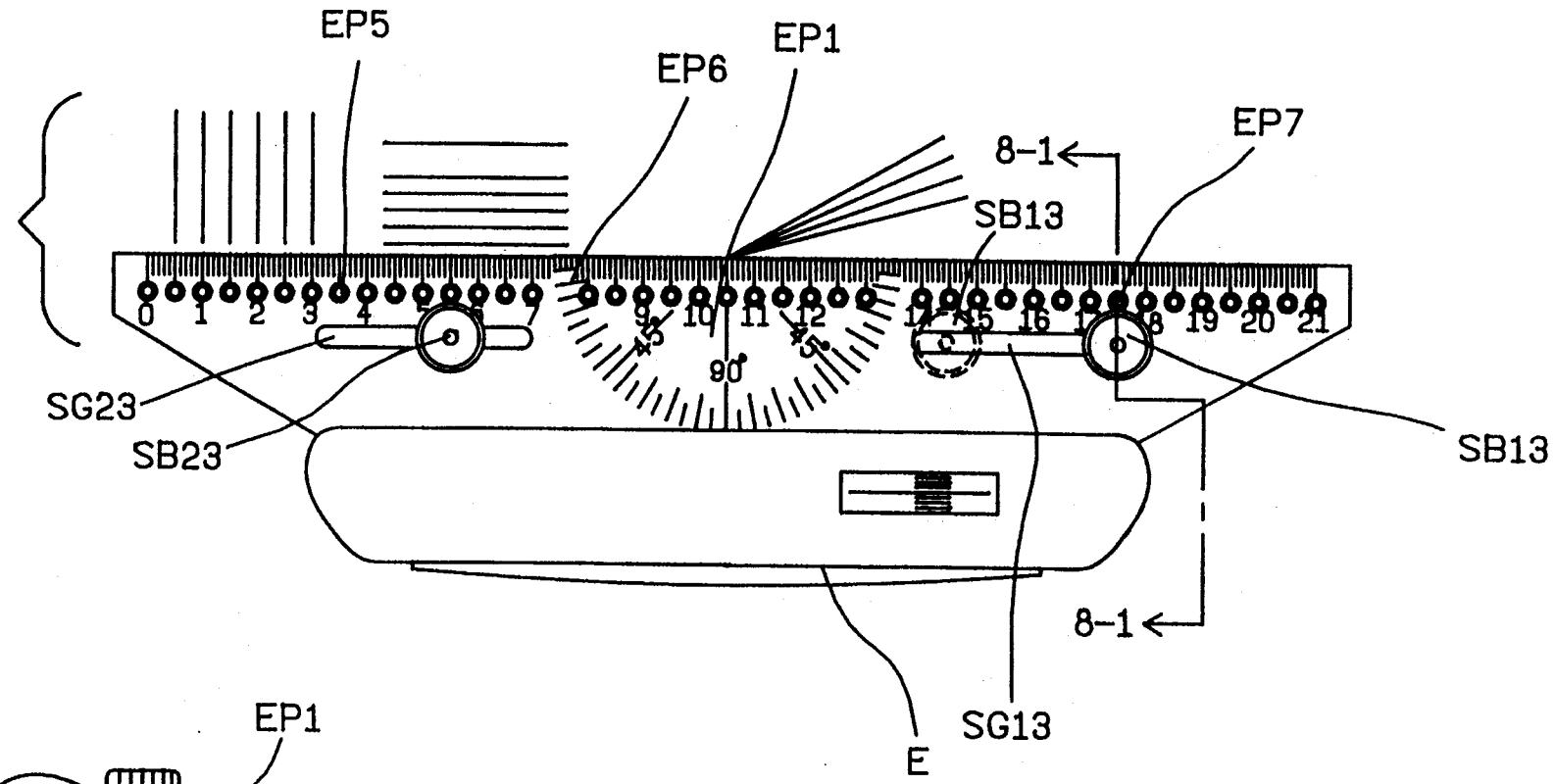
FIGS. 8A to 8C are two further top views showing two further preferred embodiments of a rolling rule according to the present invention.
Figure 8B:
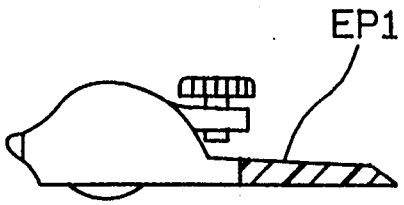
Figure 8C:
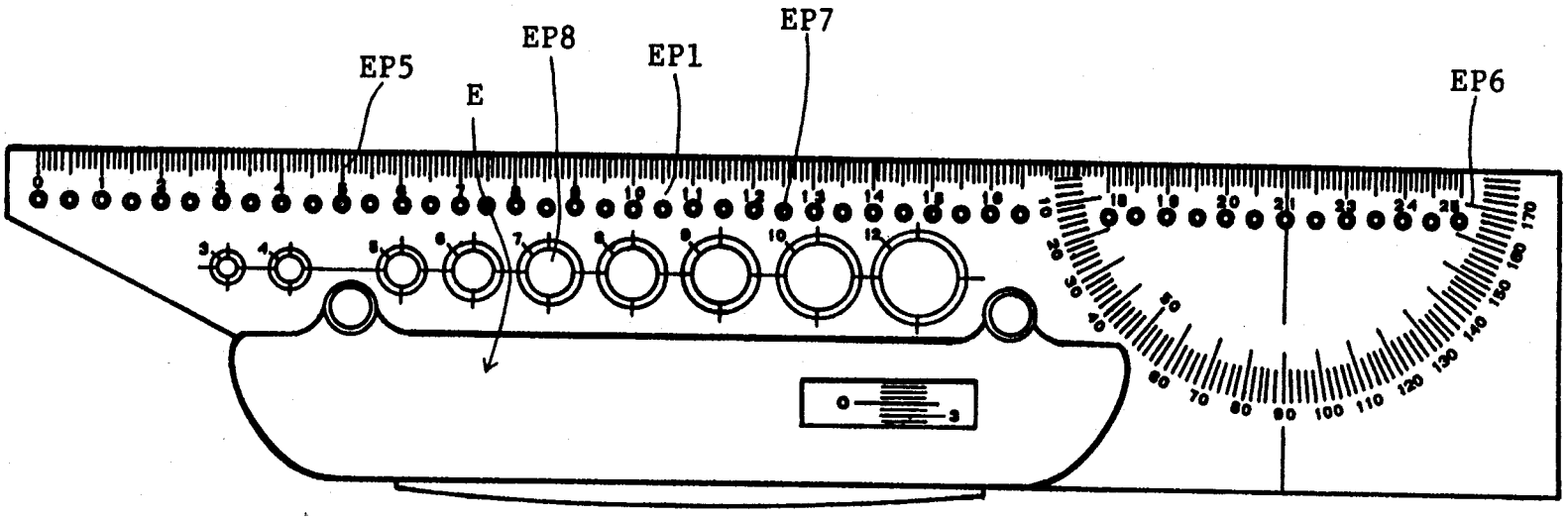

Referring to FIGS. 8A to 8C, the lower pieces EP1 are provided with a length scale EP5, an angular scale EP6 and plural holes EP7 each of which can pass therethrough a pen nib and lower piece EP1 in FIG. 8C further includes plural differently sized holes EP8 unnecessarily being circular as shown.

In use, rule body E attaching thereto the ruling gage H can freely and positively be parallelly translated if the braking means D frees from engaging with the annular sleeve S. If the braking means D is exercised, end D4 (or braking medium D5) will engage with the annular sleeve S to thus stop rule body E.

While the present invention has been described in connection with what are presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

What I claim is:

1. A rolling rule comprising:

a rule body;

a roller rotatably mounted in said rule body for enabling said rule body to be generally easily translated parallel to an underlying work piece surface; braking means mounted on one side of said rule body, which braking means subjects said roller to a braking force exerted generally along a direction parallel to the work piece surface for permitting said braking means to easily and conveniently brake said roller when a braking occasion is desired, and said braking means including an elongate braking member movably confined in said rule body and engageable with said roller, a resilient member mounted between said braking member and said rule body for always urging said braking member away from said rule body and two annular sleeves extending around said roller and enagageable with said braking means; and an outer surface layer having a relatively high frictional coefficient and surrounding said roller for enabling said roller to be positively controlled in motion or at a stop.

2. A rolling rule according to claim 1 wherein said roller includes thereon an intermediate tubular member and two end wheels providing thereon said outer surface layer.

3. A rolling rule according to claim 1, further including clamping means supported by said rule body and adapted to replaceably clamp thereto a first ruling gage.

4. A rolling rule according to claim 3 wherein said clamping means includes:

a first lower piece supported by said rule body;

a first upper piece disposed above said lower piece for cooperating with said lower piece to clamp therebetween the first ruling gage; and a packing medium enabling said pieces to tightly clamp therebetween the first ruling gage.

5. A rolling rule according to claim 1 further comprising clamping means supported by said rule body and a first ruling gage releasably fixed with respect to said rule body by said clamping means, and said first ruling gage further including;

a stem which has a terminal having an extension which has a base line;

a gage body having a corresponding terminal forming thereon a protractor which as a graduation; and a positioner mounted between said terminal and said corresponding terminal for keeping said stem at a specific inclination with respect to said rule body.

6. A rolling rule according to claim 5 wherein said stem further includes:

at least one groove provided on said stem; and at least one corresponding packing means mounted on said at least one groove for clamping thereby a second ruling gage.

7. A rolling rule according to claim 4 wherein said pieces are integrally formed to said rule body and said upper piece is essentially positioned intermediately.

8. A rolling rule according to claim 4, wherein said clamping means further comprises a second upper piece and wherein said upper pieces are disposed near two opposite ends of said rule body and said lower piece has a length approximately equal to that of said rule body.

9. A rolling rule according to claim 4 wherein said clamping means further comprises at least a second lower piece coplanar with said first lower piece.

10. A rolling rule according to claim 4 wherein said packing medium is one selected from a group consisting of an arc surface integrally formed on said first upper piece and a bolt extending through said first upper piece.

11. A rolling rule according to claim 4 wherein said first lower piece has two ends each releaseably and pivotally connected to a respective one of two ends of said rule body.

12. A rolling rule according to claim 9 wherein said second lower piece is integrally formed with said first lower piece.

13. A rolling rule according to claim 4 wherein said first lower piece has one end pivotally connected to one corresponding end of said rule body.

14. A rolling rule according to claim 13 wherein said one end has a base line and said one corresponding end forms thereon a protractor.

15. A rolling rule according to claim 14, further comprising a positioner mounted between said one end and said one corresponding end for positioning said lower piece at a specific inclined angle with respect to said rule body.

16. A rolling rule according to claim 1 wherein each of said annular sleeves for engaging with said braking means includes an exterior frictional surface.

17. A rolling rule according to claim 1 wherein each of said sleeves has an annular outer toothed surface.

18. A rolling rule according to claim 1 wherein said annular sleeves and said braking medium respectively include a ridge and a corresponding indentation for receiving therein said ridge.

19. A rolling rule according to claim 1, further including a distance-showing device for showing how much distance said roller has been translated forwards.

20. A rolling rule according to claim 19 wherein said distance-showing device includes a transparent top window mounted on said rule body, a graduation mounted on said roller, and a base line mounted on said rule body.

21. A rolling rule according to claim 19, further including an inverse distance-reading device for showing how much distance said roller has been translated backwards.

22. A rolling rule comprising:

a rule body;

a roller rotatably mounted in said rule body for enabling said rule body to be easily translated generally parallel to an underlying work piece surface;

braking means mounted on one side of said rule body surface for exerting a braking force generally along a direction parallel to the work piece surface for permitting said braking means to easily and conveniently brake said roller when a braking occasion is desired, and said braking means including a lever pivotally fixed to said rule body and having a first end engagable with said roller and a second opposite end and a resilient member mounted between said rule body and one of said first and second ends for always urging said first end away from said roller, an annular sleeve wrapped around said roller and engagable with said braking means;

an outer surface layer having a relatively high frictional coefficient and surrounding said roller for enabling said roller to be positively controlled in motion or at a stop;

a ruling gage;

a first lower piece supported by said rule body;

a first upper piece supported by said rule body and disposed above said lower piece for cooperating with said lower piece to clamp therebetween said ruling gage; and a packing medium enabling said pieces to tightly clamp therebetween said ruling gage.

* * * * *